US009828563B2

(12) United States Patent
Scott et al.

(10) Patent No.: US 9,828,563 B2
(45) Date of Patent: Nov. 28, 2017

(54) MOLYBDENUM DISULFIDE COATED NON-FERROUS AND FERROUS MATERIALS AND METHODS FOR COATING THE NON-FERROUS AND FERROUS MATERIALS WITH MOLYBDENUM DISULFIDE

(71) Applicants: Mark A Scott, Pinehurst, NC (US); Jeremiah L. Ritter, Pinehurst, NC (US)

(72) Inventors: Mark A Scott, Pinehurst, NC (US); Jeremiah L. Ritter, Pinehurst, NC (US)

(73) Assignee: Thermal Metal Treating, Inc., Aberdeen, NC (US)

( * ) Notice: Subject to any disclaimer, the term of this patent is extended or adjusted under 35 U.S.C. 154(b) by 52 days.

(21) Appl. No.: 14/790,627

(22) Filed: Jul. 2, 2015

(65) Prior Publication Data

US 2016/0017249 A1 Jan. 21, 2016

Related U.S. Application Data

(60) Provisional application No. 62/020,098, filed on Jul. 2, 2014.

(51) Int. Cl.

| | |
|---|---|
| ***C10M 125/22*** | (2006.01) |
| ***C22C 38/00*** | (2006.01) |
| ***C22C 19/05*** | (2006.01) |
| ***C23C 24/00*** | (2006.01) |
| ***C22C 38/58*** | (2006.01) |
| ***C22C 38/02*** | (2006.01) |

(52) U.S. Cl.

CPC ..... *C10M 125/22* (2013.01); *C22C 38/002* (2013.01); *C22C 38/02* (2013.01); *C22C 38/58* (2013.01); *C23C 24/00* (2013.01); *C10M 2201/0663* (2013.01); *C22C 19/056* (2013.01)

(58) Field of Classification Search

CPC ..... C10M 125/22; C10M 2201/0663; C22C 19/056; C22C 38/002; C22C 38/02; C22C 38/58; C23C 24/00

USPC ..... 508/103

See application file for complete search history.

(56) References Cited

U.S. PATENT DOCUMENTS

| | | | | |
|---|---|---|---|---|
| 2,941,288 | A | 6/1960 | Whitehouse | |
| 3,914,178 | A | 10/1975 | Fineran et al. | |
| 4,140,834 | A | 2/1979 | Marcantonio et al. | |
| 4,180,603 | A * | 12/1979 | Howell, Jr. | B05D 7/142 427/353 |
| 4,291,073 | A | 9/1981 | Soutsos | |
| 5,063,258 | A * | 11/1991 | Babler | C08K 3/30 523/171 |
| 6,284,322 | B1 | 9/2001 | Nazaryan et al. | |
| 7,105,472 | B2 | 9/2006 | Zepf | |
| 2002/0110438 | A1* | 8/2002 | Murakami | F16B 5/0208 411/120 |
| 2003/0110888 | A1* | 6/2003 | Kosco | C22C 1/05 75/255 |
| 2004/0194667 | A1 | 10/2004 | Reuscher | |
| 2004/0195826 | A1 | 10/2004 | Goto | |

OTHER PUBLICATIONS

Bonderite L-GP M 206 Acheson Technical Process Bulletin, issued Jul. 8, 2013, retrieved from the internet at <<http://www.palmerholland.com/Assets/User/Documents/Product/43165/14/MITM04840.pdf>> on Oct. 12, 2016.*

Jones, T.C., "Dip Coating", Metal Finishing 2010, 108 (11-12), 130-132.*

Fastenal Engineering & Design Support, Torque-Tension Relationship for Metric Fasteners, Mar. 4, 2009 [online] hiit://www.fastenal.com/content.feds/pdf/Torque-Tension%20Chart%for%20Metric%20Fasteners.pdf.

* cited by examiner

*Primary Examiner* — James Goloboy

(74) *Attorney, Agent, or Firm* — Seth L. Hudson; Clements Bernard Walker, PLLC

(57) ABSTRACT

The present invention provides methods and systems for applying a coating to a non-ferrous or ferrous material that includes providing a material, a heat source, an immersion tank, and a drying environment. The material is placed within the heat source and heated to a temperature between the range of between about 204.44° C. to about 537.78° C. (400° F. to about 1000° F.). The material is immersed within an immersion containing a ratio of molybdenum disulfide solution to water of between about 2:1 to about 4:1 at a temperature between about 26.67° C. to about 48.89° C. (about 80° F. to 120° F.), and the material is dried at a temperature between about 51.67° C. to about 98.89° C. (125° F. and 210° F.).

14 Claims, No Drawings

MOLYBDENUM DISULFIDE COATED NON-FERROUS AND FERROUS MATERIALS AND METHODS FOR COATING THE NON-FERROUS AND FERROUS MATERIALS WITH MOLYBDENUM DISULFIDE

CROSS-REFERENCE TO RELATED APPLICATION(S)

The present non-provisional patent/patent applications claims priority to U.S. Provisional Patent Ser. No. 62/020,098 filed Jul. 2, 2014 and entitled "NON-FERROUS AND FERROUS MATERIALS AND METHODS FOR COATING THE NON-FERROUS AND FERROUS MATERIALS," the contents of which are incorporated by reference herein.

FIELD OF THE INVENTION

The present invention relates generally to non-ferrous and ferrous materials, including fastening devices, such as nuts, bolts, and the like, that have increased structural wearability and stability, and a process for treating non-ferrous and ferrous materials, including a metal fastener, such as nuts, bolts, and the like, composed of stainless steel, titanium, aluminum, Hastelloy, and galvanized zinc, for increasing structural wearability and stability.

BACKGROUND OF THE INVENTION

The non-ferrous and ferrous materials, such as fastening devices, made in accordance with the present invention, improve the properties of these devices. The process disclosed herein improves the properties of non-ferrous and ferrous materials, such as fastening devices. For example, the fastening devices of the present invention may be nuts, bolts, and like fasteners.

Fasteners, especially threaded fasteners, can experience thread galling when placed under heavy pressure. Galling, also referred to as a cold-welding process, can occur when the male and female surfaces of threads are subjected to heavy pressure. Stainless steel fasteners are particularly susceptible to thread galling, which occurs when pressure builds between the contacting thread surfaces and breaks down the protective oxide coatings, during tightening. The galled fastener, such as nuts or bolts, may pass all required inspections for thread, material, and mechanical, but fail to function together.

There is a need for a fastening device and process for manufacturing a ferrous or non-ferrous fastening device that is resistant to galling and the present invention serves this purpose.

BRIEF SUMMARY OF THE INVENTION

According to an embodiment of the present invention, the present invention provides methods and systems for applying a coating to a non-ferrous or ferrous material that includes providing a material, a heat source, an immersion tank, and a drying environment. The material is placed within the heat source and heated to a temperature between the range of about 204.44° C. to about 537.78° C. (400° F. to about 1000° F.). The material is immersed within an immersion in the immersion tank containing a ratio of molybdenum disulfide solution to water of between about 2:1 to about 4:1 at a temperature between about 26.67° C. to about 48.89° C. (80° F. to about 120° F.), and the material is dried at a temperature between about 51.67° C. to about 98.89° C. (about 125° F. and about 210° F.).

According to another embodiment of the present invention, a process for applying a coating to a non-ferrous or ferrous material by heating in a convection oven.

According to yet another embodiment of the present invention, a process for applying a coating to a non-ferrous or ferrous material that includes an immersion tank with an agitator.

According to yet another embodiment of the present invention, a process for applying a coating to a non-ferrous or ferrous material that includes a molybdenum disulfide solid in the immersion of between about 1.5% and 8.3%.

According to yet another embodiment of the present invention, a process for applying a coating to a non-ferrous or ferrous material with a pH of the immersion between about 3.0 to about 8.5.

According to yet another embodiment of the present invention, a process for applying a coating to a non-ferrous or ferrous material whereby the material is immersed in the immersion between about 2 seconds to about 2 minutes.

According to yet another embodiment of the present invention, a process for applying a coating to a non-ferrous or ferrous material including applying a light oil to the material.

According to yet another embodiment of the present invention, a process for applying a coating to a non-ferrous or ferrous material including adding a coloring agent to the molybdenum disulfide solution.

According to yet another embodiment of the present invention, a fastener that is coated with a molybdenum disulfide solution.

DETAILED DESCRIPTION OF THE INVENTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Further, all ranges disclosed herein are intended to include any combination of the mentioned upper and lower limits even if the particular combination and range is not specifically listed. Correspondingly, all upper and lower limit values mentioned herein are intended to illustrate any combination thereof even if the particular combination and range is not specifically mentioned.

The subject invention is directed in one of its aspects to an improved ferrous or non-ferrous material, such as a fastener, and an improved process for the coating of the ferrous or non-ferrous material, such as a fastener. The material, such as a fastener, includes a coating and the process for producing the material is designed to produce a fastener with a film lubrication coating, having a low coefficient of friction, lubricating coating. The coating on the fastener prevents galling, on stainless steel, zinc, and aluminum, titanium, Hastelloy, and galvanized zinc and is a superior, long lasting, lubricating film.

The coating is a molybdenum disulfide coating, and applied, using a thermal process defined below, to a metal surface, resulting in a fusion bond. The molybdenum disulfide coating penetrates into the micro-discontinuities on the materials surface and creates a permanent dry film coating between about 3 to about 50.8 microns (from about 0.00012 inches to about 0.002 inches). The most intimate bond of the coating occurs within about 2.5 to about 5.1 microns (from about 0.0001 to about 0.0002 in.) thickness on the metal surface.

The molybdenum disulfide is commercially available from a number of commercial sources. The coating is dry to the touch when adhered to the materials surface, resulting in a dark gray appearance as opposed to the normally shiny surface. When frictional forces are applied to the coating, the coating will burnish into the surface of the material, and become a permanent lubricant coating. The coated material or coated fastener will withstand severe environments, such as acid, gasoline, and various, severe outdoor exposure and the like.

The novel process of coating the material with the molybdenum disulfide requires a heat source, such as a conventional convection oven that is either electric or indirect gas fired, induction, or infrared. The heat source should be able to obtain a temperature within the range of from about 204.44° C. to about 537.78° C. (about 400° F. to about 1000° F.), including all points in-between. The temperature within the process may be adjusted depending upon the desired result of the user. The material is first pretreated to clean the material prior to applying the coating. Once the material has been cleaned, it is placed within the heat source. The soak time within the heat source is a product of the cross-section of the material to be processed and the heat source. The soak time within the heat source is between about 2 seconds to 2 hours, preferably between about 5 seconds to about 1 hour. Once the desired temperature and soak time is reached, the material is immersed in a molybdenum disulfide bath, coating the material.

In the immersion in the immersion tank, the molybdenum disulfide coating is maintained at a temperature between the range of from about 26.67° C. to about 48.89° C. (from about 80° F. to about 120° F.), including all points in-between, depending upon the desired thickness of the coating. The molybdenum disulfide can be adjusted in a range of between about 1.5% to about 8.3%, including all points in-between. The pH of the coating is maintained within a range of between about 3.0 to about 8.5, including all points in-between. Preferably, the pH range is in the range between about 6.0 to about 8.0, including all points in-between. The ratio of coating to water in the immersion is from about 1:1 to about 5:1, preferably from about 2:1 to about 4:1, and more preferably about 3:1. The immersion time is between about 1 second to about 10 minutes, including all points in-between, and preferably between about 2 seconds to 2 minutes, including all points in-between. The immersion tank contains an internal agitator for maintaining the solids in suspension.

The coating on the fastener may be cured in a heat source at a temperature of between about 51.67° C. to about 98.89° C. (from about 125° F. to about 210° F.) for a period of between about 1 minute to about 15 minutes. In another alternative embodiment, optionally a light oil may be applied to the material after the material has been immersed in the molybdenum disulfide, coated with the molybdenum disulfide, and the molybdenum disulfide has dried on the material. The oil is applied to the material by immersing the material in an immersion consisting of from about 5% to 15% oil and from about 95% to about 75% water, and more preferably about 10% oil and 90% water.

The fasteners according to the present invention can withstand torque loads greater than or equal to 300 ft-lbs.

The coating may include coloring agents, stabilizers, antioxidants, water dispersing rust preventative lubricants and other rubber and plastic compounding ingredients without departing from the scope of this invention.

The metal used in the present invention may be stainless steel, including 300 series stainless steel surfaces, titanium, aluminum, Hastelloy, and galvanized zinc.

EXAMPLES

Examples of the process and the coated material is illustrated in the following examples. Exemplary Examples are reproduced below exemplifying the process for coating various fasteners, including the testing of these fasteners for gall:

Example 1

Example 1 is designed to coat a throttle shaft. The heat source is set to 332.22° C. (630° F.). The molybdenum disulfide is in a solids range of from about 7.7% to about 8.3% and the pH is between about 7.5 to 8.5 in an immersion bath. The shaft is placed in the heat source from between about 1 to 2 minutes until the shafts reach 232.22° C. (450° F.). The shafts are submersed in the immersion and then dried at 79.44° C. (175° F.).

Example 2

Example 2 is designed to coat a throttle shaft. The heat source is set between about 354.44° C. to 371.11° C. (670° F. to 700° F.) and the quench drive belt is set to a speed of 80. The immersion temperature is kept between about 32.22° C. to about 48.89° C. (about 90° F. to about 120° F.). The molybdenum disulfide is in a solids range of from about 7.7% to about 8.3% and the pH is between about 6.5 to 7.5 in an immersion bath. The shaft is placed in the heat source from between about 1 to 2 minutes until the shafts reach (232.22° C.) 450° F. The shafts are submersed in the immersion and then dried at between 90.56° C. to 98.89° C. (195° F. to 210° F.).

Example 3

A fastener, specifically a nut and bolt, were coated with molybdenum disulfide as set forth in the present application. The nut and bolt were subjected to torque tests, and the torque tests were initially run in a conventionally prescribed manner. The nut was manually attached onto the bolt with a torque wrench beginning at 50 Ft. Lbs. and backing off and proceeding to repeat that process over again until a 150 Ft, Lbs. load was reached, which is the load limit for that particular torque wrench, which was sold under the tradename Carlyle and available for purchase through NAPA Auto Parts. The comparative fasteners didn't exceed 120 Ft. Lbs.

The tests achieved torque loads exceeding 300 foot pounds, indicated by the torque load values that the impact wrench used in testing, is marketed to achieve, which is 340 Ft. Lbs. The test samples stalled out the wrenches rotary motion, which is the point at which the slip clutch engages when it reaches 340 Ft Lbs. This was done repeatedly with the tested nut reaching temperatures exceeding 200° F. measured by a calibrated laser temperature gauge. This was done without any galling (pressure welding metals together) any of the two tested metal parts in constant contact with one another.

This same test was conducted with the bolt part wetted and covered with silica sand before turning the accompanying nut on with the same torque impact wrench. This same test procedure was further tested with the bolt threads damaged by deforming them with putting deep V notches across the threads in several locations using a hammer and chisel. The test results for all these conditions were the same—no galling occurred.

All tests were run with only the original coating applied no additional coating was applied to any test samples once the tests were begun.

Example 4

In this example, a ½" standard nut, ½" stud, ⅝" oversized (pitch diameter increased by 0.006) nut, and ¾" oversized nut were coated with the molybdenum disulfide according to the present invention. Approximately, 20 of each nut were coated and had a matte gray appearance after coating.

Five samples of the ½" nut were tested on the molybdenum disulfide coated studs and five nuts were tested on studs coated with a competitors coating. Five samples of both the ⅝" and ¾" nuts were tested on 304SS bolts coated with a competitors coating and 304SS bolts coated with molybdenum disulfide according to the present invention. The clamping force of the fastener combination was measured with a load-cell with applied torque values of 50-100 ft.-lbs. in 5 ft.-lb. increments. The friction factor, k, was calculated from the test data and is shown in Table 1.

TABLE 1

| Test Specimen | Molybdenum Disulfide k | Currently Used Coating k |
|---|---|---|
| ½" STD Nut & coated stud | .169 | — |
| ½" STD Nut and Uncoated stud | .214 | .329 |
| ⅝" OS Nut & Un-Coated Bolt | .125 | .12 |
| ¾" OS Nut & Uncoated bolt | .301 | .261 |

Example 5

Two ¾"-16×3½" bolts and ¾"-16 nuts were used in Example 5. One bolt and nut was coated in accordance with the present invention, and the second nut and bolt were not coated and left in original form. Torque was applied to the nut and galling occurred on the uncoated nut and bolt at 8,000 lbf @ 150 ft-lbs. In comparison, the coated bolt and nut withstood a torque of 20,500 lbf at 150 ft-lbs.

Example 6

Two ⅝"-20×3½" bolts and ⅝"-20 nuts were used in Example 6. One bolt and nut was coated in accordance with the present invention, and the second nut and bolt were not coated and left in original form. Torque was applied to the uncoated nut and galling occurred on the uncoated nut and bolt at 6,000 lbf @ 100 ft-lbs. In comparison, the coated bolt and nut withstood a torque of 17,500 lbf at 100 ft-lbs.

Example 7

A 2.5×⅝ hex head nut and bolt were coated with molybdenum disulfide in accordance with the present invention. A simulated test to determine the effects of atmospheric (NaCL) salt on the galling effect of the stainless steel head nut and bolt was conducted in a certified ASTM B 117 salt fog chamber, under D1654 conditions. The sample was run for a cycle time of 3600 hours to gauge the potential longevity of the molybdenum disulfide coating, coated in accordance with the present invention, in marine atmospheric and winter, salted road, icing conditions. Both repetitious torque wrench and electrical impact wrench tests were run on the head nut and bolt to gauge the durability over many cycles of used during the nut and bolt working lifetime.

Tests on the nut and bolt began when the tested sample was removed from the test chamber and not cleaning of the part or additional coating was applied after removal. The nut and bolt were subjected to 10 repetitions beginning at 90 ft-lbs of torque using a JCM calibrated torque wrench and going in 10 foot pound increments to 150 ft-lbs of force. During these repetitions, no galling or hesitancy on the smooth turning of the nut on the bolt was observed.

Following the torque test, an electrical Dewalt®, 340 foot pound impact driver was used to continuously run the nut from the top and then to the mid-point of the threads, where it bottomed out against a steel block, for 20 repetitions. This test caused noticeable thread wear and heat to be generated on both the nut and bolt threads. Following this test, a finger tightening trial of the nut would stop mid-point on the bolt, the most noticeable wear area. A modest end wrench force was used to overcome the thread deformation and would continue onto the bottom of the bolt threads, allowing the nut to pass over the area with finger force. The threads of the bolt did not gall or begin to show signs of galling during these tests.

Example 8

Example 8 consists of testing a racing engine combined head pan and head pan stud, and specifically head studs from a top fuel dragster was tested for torque load and material stretching characteristics. A 9/16×18 thread inch size of a head bolt and ½×20 inch head pan bolt were coated with molybdenum disulfide in accordance with the present invention. The nuts and bolts consist of SAE H 11 tools steel. Six of the coated head bolts and head pan bolts were installed in a 7000 HP engine that ran for 20 consecutive Top Fuel Drag Races. The engine was torn down and rebuilt after each race and each time the six coated threads did not gall. The other studs used and coated with a commonly used petroleum based anti-seize material experienced galling failures. This testing and the torque load and stretch tests indicate high compressive strength loads during the same test cycles, indicating higher lubricity attained by the molybdenum disulfide coated parts over the commonly used petroleum based anti-seize material.

The results of this test are indicated below in Table 2 and Table 3, wherein Table 2 indicates the test results for the 9/16×18 thread inch head bolt and Table 3 indicates the test results for the ½×20 inch head pan bolt.

TABLE 2

| | Tension, ft-lbs | Elongation @ torque | Elongation after and unloaded |
|---|---|---|---|
| Uncoated | 25,000 | .073" | .0165" |
| Coated with Molybdenum Disulfide | 30,200 | .072" | .006" |

TABLE 3

| | Tension, ft-lbs | Elongation @ Torque | Elongation after and unloaded |
|---|---|---|---|
| Uncoated | 27,000 | .028" | .013" |
| Coated with Molybdenum Disulfide | 32,000 | .026" | .006" |

Example 9

A clamping force test was conducted on a ¾-16×3.5 inch bolt and nut and a ⅝-20×3.5 inch bolt and nut. Torque load tests were conducted to establish the clamping force difference between uncoated SAE 316 stainless steel nuts and bolts and nuts and bolts coated with molybdenum disulfide in accordance with the present invention. The uncoated ⅝-20 inch nut and bolt combination developed 6,000 pounds of clamping force at 100 ft-lbs of torque load and 17,500 lbs of clamping force at the same 100 ft-lbs of torque. The ¾ inch nut and bolt combination developed 8,000 pounds of clamping force at 150 ft-lbs of torque and 20,500 pounds of clamping force at the same 150 ft-lbs of torque load. The differences of the clamping force generated by the torque loads indicated the lubricity and compression loading capability of the coating of the present invention and the process of coating a nut and bolt versus and uncoated part.

Example 10

A hex bolt and nut, coated in accordance with the present invention, were tested to determine whether they could withstand the effects of exposure to Nitric Acid. A ⅜ inch, 4 inch diameter, SAE 304 stainless steel nut and bolt were tested. A beaker was used containing 25% nitric acid and 75% tap water at ambient temperature was used as an immersion. The molybdenum disulfide coated nut and bolt were immersed in the beaker for time exposure and reactivity observations. After 6 hours of contact time, the nut and bolt did not exhibit any breakdown of the coating. After 24 hours of contact time, the nut and bolt did not exhibit any breakdown of the coating. The nut and bolt were then torque tested using an Armstrong torque wrench capable of applying 50 to 240 ft-lbs of torque. Starting at 50 ft-lbs, five repetition cycles were conducted to torque load setting, then moved to the next in 10 ft-lb increments with an additional five repetitions through 110 ft-lbs with no signs of galling for a total of 35 cycles. When it reached the 130 ft-lb test, the 9/16 inch deep well socket deformed the nut galled and adhered to the bolt. The maximum recommended torque load for the stainless steel nut and bolt is 231 in-lbs or the equivalent of 20 ft-lbs. The 120 ft-lb torque loads sustained during this test procedure is six times greater force than the parts were designed for without a galling event.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A process for applying a coating to a non-ferrous or ferrous material, comprising:

providing a material, a heat source, an immersion tank, and a drying environment;

placing the material within the heat source;

heating the material to a temperature between the range of between about 204.44° C. to about 537.78° C. (about 400° F. to about 1000° F.);

immersing the material within an immersion containing a ratio of molybdenum disulfide solution to water of between about 2:1 and about 4:1 at a temperature between about 26.67° C. to about 48.89° C. (about 80° F. to about 120° F.);

applying an oil to the material; and drying the material at a temperature between about 51.67° C. to about 98.89° C. (about 125° F. to about 210° F.).

2. The process according to claim 1, wherein the heat source is a convection oven.

3. The process according to claim 1, wherein the immersion tank contains an agitator.

4. The process according to claim 1, wherein the molybdenum disulfide solid in the immersion is between about 1.5% and 8.3%.

5. The process according to claim 1, wherein the pH of the immersion is between about 3.0 to about 8.5.

6. The process according to claim 1, wherein the material is immersed in the immersion between about 2 seconds to about 2 minutes.

7. The process according to claim 1, further comprising adding a coloring agent to the molybdenum disulfide solution.

8. A process for applying a coating to a non-ferrous or ferrous material, comprising:

providing a material, a heat source, an immersion tank, and a drying environment;

placing the material within the heat source;

heating the material to a temperature between the range of between about 204.44° C. to about 537.78° C. (400° F. to about 1000° F.);

immersing the material within an immersion containing a ratio of molybdenum disulfide solution to water of about 3:1 at a temperature between about 26.67° C. to about 48.89° C. (about 80° F. to 120° F.);

applying an oil to the material; and drying the material at a temperature between about 51.67° C. to about 98.89° C. (125° F. and 210° F.).

9. The process according to claim 8, wherein the heat source is a convection oven.

10. The process according to claim 8, wherein the immersion tank contains an agitator.

11. The process according to claim 8, wherein the molybdenum disulfide solid in the immersion is between about 1.5% and 8.3%.

12. The process according to claim 8, wherein the pH of the immersion is between about 3.0 to about 8.5.

13. The process according to claim 8, wherein the material is immersed in the immersion between about 2 seconds to about 2 minutes.

14. The process according to claim 8, further comprising adding a coloring agent to the molybdenum disulfide solution.

* * * * *